US008721370B2

(12) United States Patent
Liu et al.

(10) Patent No.: US 8,721,370 B2
(45) Date of Patent: May 13, 2014

(54) USB CONNECTOR

(75) Inventors: Su-Li Liu, Kaohsiung (TW); Li-Chien Yang, Kaohsiung (TW)

(73) Assignee: Won-Hsin Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 13/604,693

(22) Filed: Sep. 6, 2012

(65) Prior Publication Data

US 2013/0072064 A1 Mar. 21, 2013

(30) Foreign Application Priority Data

Sep. 21, 2011 (TW) ..... 100217714 U

(51) Int. Cl.
*H01R 24/00* (2011.01)

(52) U.S. Cl.
USPC ..... 439/660; 439/76.1

(58) Field of Classification Search
USPC ..... 439/660, 630, 76.1
See application file for complete search history.

(56) References Cited

U.S. PATENT DOCUMENTS

| | | | | |
|---|---|---|---|---|
| 7,442,051 | B2 * | 10/2008 | Jiang et al. | 439/76.1 |
| 7,540,786 | B1 * | 6/2009 | Koser et al. | 439/660 |
| 7,553,172 | B2 | 6/2009 | Chiu et al. | |
| 7,604,512 | B1 | 10/2009 | Chen | |
| 7,946,857 | B2 * | 5/2011 | Wang | 439/76.1 |
| 7,959,478 | B2 | 6/2011 | Chiu et al. | |
| 8,167,658 | B1 * | 5/2012 | Liu | 439/630 |
| 8,480,435 | B2 * | 7/2013 | Hsiao et al. | 439/660 |

* cited by examiner

*Primary Examiner* — Hien Vu
(74) *Attorney, Agent, or Firm* — Muncy, Geissler, Olds & Lowe, P.C.

(57) ABSTRACT

A USB connector comprising an insulating base, a plurality of conducting terminals, a circuit board and a housing is disclosed. The insulating base has a plurality of slots at an end of the insulating base and a plurality of abutting grooves on a surface of the insulating base, with each abutting groove communicating with a respective one of the slots. Each conducting terminal is inserted in a respective one of the slots and has an abutting portion arranged in one of the abutting grooves communicating with the respective slot. The circuit board abuts against the surface of the insulating base whereon forms the abutting grooves, with the circuit board having a plurality of electrical contacts electrically connecting with the abutting portions of the plurality of conducting terminals. The housing is hollow to receive the insulating base and circuit board.

5 Claims, 7 Drawing Sheets

USB CONNECTOR

BACKGROUND OF THE INVENTION

1. Field of the Invention

The present invention relates to a Universal Serial Bus (USB) connector and, more particularly, to a USB connector used in Universal Serial Bus 3.0 (USB 3.0) specification.

2. Description of the Related Art

Universal Serial Bus has been the most popular interface in signal transfer among a variety of electronic devices. Specifically, USB has been commonly used to transfer signals among peripheral devices for computers and digital audio-visual equipments, such as keyboards, mice, flash drives and card readers.

The USB specification has been upgraded from version 1.0 (proposed in 1996) to version 2.0, then further to version 3.0 in 2008. In contrast to USB 2.0 which uses a pair of power lines and a pair of differential data wires to transfer signals in half duplex operation, USB 3.0 uses two pair of signal wires and a ground wire to transfer signals in full duplex operation. One pair of signal wires is adapted to transfer signals and the other pair of signal wires is adapted to receive signals, thereby separating the data transmission and acknowledgement processes. This allows USB 3.0 to reach a data transfer rate as high as 4.8 Gbps which is ten times faster than USB 2.0. USB 3.0 relatively has a larger amount of conducting terminals compared to USB 2.0.

A conventional USB connector generally includes an insulating base, a plurality of conducting terminals and a circuit board. The insulating base has a plurality of grooves. The circuit board mounted in the insulating base has a plurality of electrical contacts. Each conducting terminal is mounted in the corresponding groove and connects with the corresponding electrical contact of the circuit board. During the manufacturing process of the USB connector, the plurality of conducting terminals is inserted into the grooves of the insulating base one by one, and melting plastic is then injected into the grooves of the insulating base. In this manner, the USB connector is integrally formed after the plastic cools down. By applying such fabrication process, each conducting terminal forms a point of contact with the corresponding electrical contact, allowing the conducting terminals of the USB connector to be coupled with the insulating base by way of adhesion.

However, once the machines breakdown or the materials on the conveyer experience undesired shifts in position during the manufacturing process of the conventional USB connector, the conducting terminals are placed in wrong positions, which locate the contacts between the conducting terminals and the circuit board incorrectly. As a result, the USB connector has an unstable signal transmission or even has no signal transmission capability when the conducting terminals are connected to the insulating base. In particular, since USB 3.0 has a larger amount of conducting terminals, it is likely that the USB connector has a low yield rate after the conducting terminals are coupled with the insulating base by adhesion, which creates the extra manufacture cost and the waste of materials. Furthermore, the points of contact between each conducting terminal and the circuit board form a structure with weak stability. If the USB connector experiences a collision, it is likely to cause problems such as difficulty in reading the data, affecting the transmission quality and causing inconvenience in use.

In addition, the conducting terminals are inseparably secured on the insulating base. For a defective USB connector, even if only one of the conducting terminals is marked as a bad contact during testing, the entire insulating base and the other conducting terminals have to be abandoned, also increasing the manufacture cost.

SUMMARY OF THE INVENTION

An objective of the present invention is to provide a USB connector that accurately locates each conducting terminal on a target position and connects the conducting terminal to the insulating base, improving the product yield rate.

Another objective of the present invention is to provide a USB connector that increases the contact area between each conducting terminal and the corresponding electrical contact, strengthening the connection thereof, ensuring the stability of the transmission quality.

Yet another objective of the present invention is to provide a USB connector that allows replacements for the broken conducting terminals, preserving the insulating base and the other conducting terminals which transmit signal properly, reducing the manufacture cost.

The present disclosure fulfills the above objective by providing a USB connector including an insulating base, a plurality of conducting terminals, a circuit board and a housing. The insulating base has a plurality of slots at an end of the insulating base and a plurality of abutting grooves on a surface of the insulating base, with each abutting groove communicating with a respective one of the slots. The plurality of conducting terminals is received in the plurality of slots, with each conducting terminal being inserted in a respective one of the slots and having an abutting portion arranged in one of the abutting grooves communicating with the respective slot. The circuit board abuts against the surface of the insulating base whereon forms the abutting grooves, with the circuit board having a plurality of electrical contacts electrically connecting with the abutting portions of the plurality of conducting terminals. The housing is hollow and receives the insulating base and circuit board.

The present disclosure further includes that a block is formed in each slot and each conducting terminal has a hook portion hooking the block in a respective one of the slots.

The present disclosure further includes that a well is defined by the block and the inner surfaces of the respect slot, and each conducting terminal has a pressing portion between the abutting portion and the hook portion, with the pressing portion extends into the well.

The present disclosure further includes that, for each conducting terminal, a section between the pressing portion and the abutting portion 21 is formed with a maximal width of the conducting terminal.

The present disclosure further includes that each slot of the insulating base has a pair of protruding portions respectively formed on two inner lateral sides of the slot, each conducting terminal has a pair of shoulders on two outer lateral sides of the conducting terminal and adjacent to the abutting portion, a section of the conducting terminal with the shoulders has a width larger than that of the slot between the two protruding portions, and each conducting terminal has a gap adjacent to the shoulder.

The present disclosure further includes that, for each conducting terminal, a first end of the conducting terminal forms the abutting portion, the pressing portion is a protrusive section, and the hook portion is a section between the pressing portion and a second end of the conducting terminal and bent toward the abutting portion.

The present disclosure further includes that a positioning plate is mounted on an end of the insulting base, the positioning plate has at least one positioning member, and each positioning member has a surface facing the said surface of the insulating base.

BRIEF DESCRIPTION OF THE DRAWINGS

The illustrative embodiments may best be described by reference to the accompanying drawings where.

Figure 1:
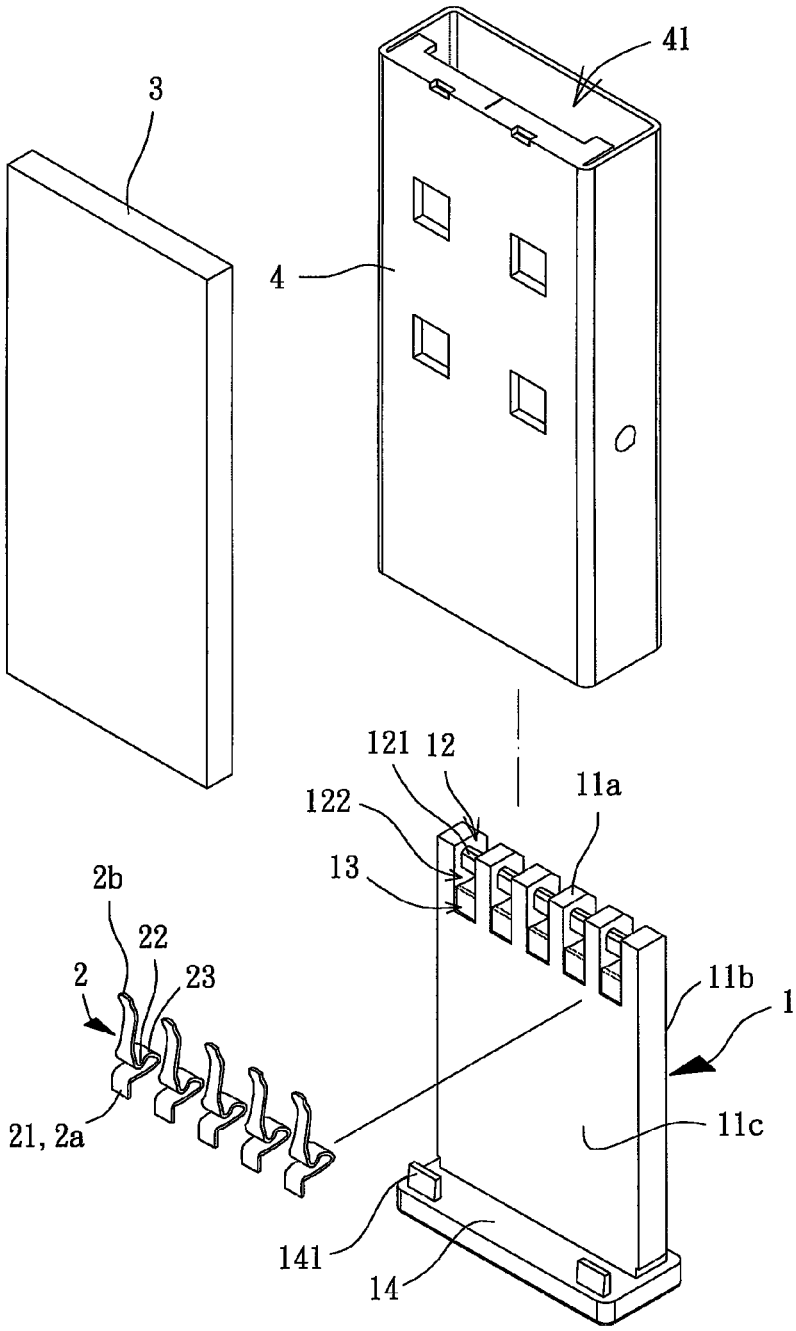
FIG. 1 shows an exploded diagram of a USB connector according to a first embodiment of the present invention.

In the various figures of the drawings, the same numerals designate the same or similar parts. Furthermore, when the term "first", "second", "third", "longitudinal", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
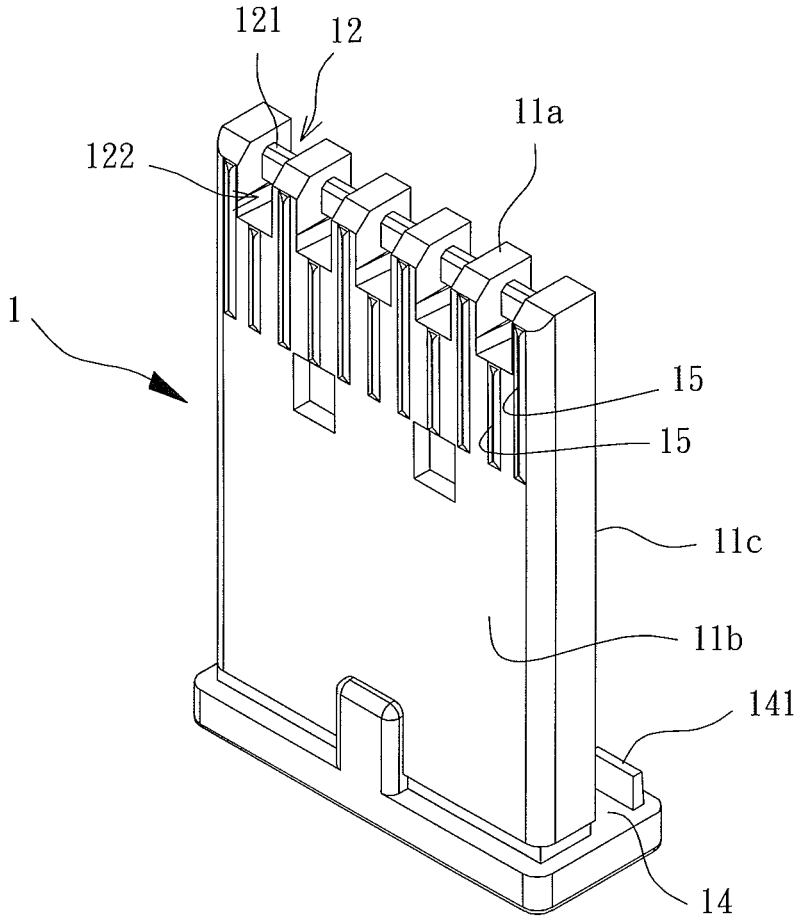
FIG. 2 shows a perspective view of the insulating base of the USB connector of the first embodiment of the present invention
Figure 3:
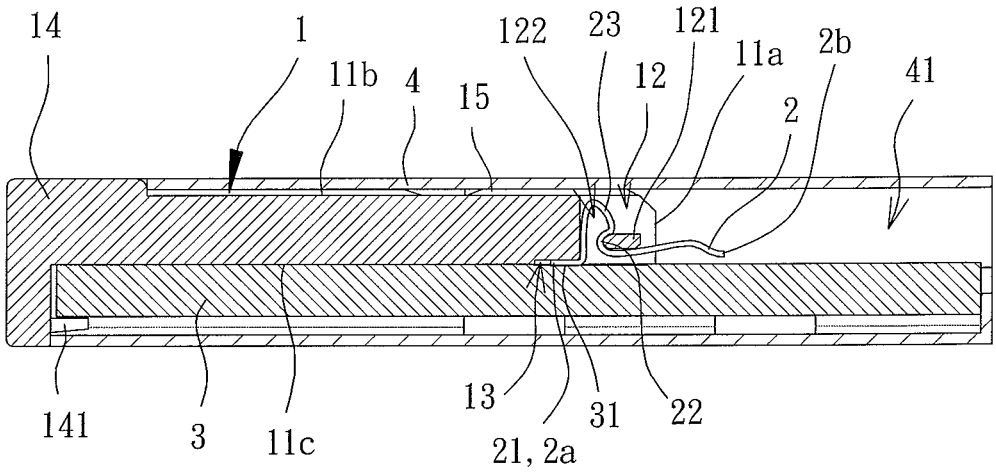
FIG. 3 shows a cross sectional view of the USB connector of the first embodiment of the present invention.

With reference to FIGS. 1, 2 and 3, a USB connector according to a first embodiment of the present invention is shown, which includes an insulating base 1 and a plurality of conducting terminals 2 connected to the insulating base 1.

The insulating base 1 includes a first surface 11*a*, a second surface 11*b*, and a third surface 11*c*. The first surface 11*a* is connected to the second surface 11*b* and the third surface 11*c* respectively, and the second surface 11*b* is opposite to the third surface 11*c*. A plurality of slots 12 is formed on an end of the insulating base 1, and any adjacent two of the slots 12 are spaced out a predetermined distance apart. Each slot 12 has at least one opening; precisely, each slot 12 is open toward the first surface 11*a* and the third surface 11*c* by the at least one opening. It is preferred that each of the respect openings of the slots 12 extends from the second surface 11*b* to the third surface 11*c* through the first surface 11*a*, allowing the conducting terminals 2 to be conveniently inserted into or pulled out from the slots 12 of the insulating base 1. In each slot 12, a block 121 is formed to define a well 122 between the block 121 and the inner surfaces of the respect slot 12. Specifically, the well 122 penetrates into the insulating base 1 from the third surface 11*c* toward the second surface 11*b* by either connecting with or spacing from the second surface 11*b*. Each conducting terminal 2 is partially inserted into the corresponding well 122 in order to be fixed therein.

The insulating base 1 also includes a plurality of abutting grooves 13 corresponding to the slots 12. Each abutting groove 13 is a dented space formed on the third surface 11*c* and communicates with a respective one of the slots 12. A positioning plate 14 is mounted on another end of the insulting base 1 without the slots 12. The positioning plate 14 includes at least one positioning member 141, and each positioning member 141 has a surface facing the third surface 11*c* of the insulating base 1.

Furthermore, the insulating base 1 can have a plurality of protrusions 15 extending outward from the second surface 11*b*. Preferably, the protrusions 15 are formed as ribs, ridges or simple blocks. As shown in FIG. 2, the protrusions 15 are spaced from each other and preferably parallel to the longitudinal direction of the insulating base 1. Preferably, the protrusions 15 are arranged at an end with the slots 12 of the insulating base 1. More preferably, each protrusion 15 is aligned with an edge of a nearby slot 12 or opposite to a respective one of the abutting grooves 13.

The conducting terminals 2 are made of conducting materials. Each conducting terminal 2 is a flexible and twisted sheet with a predetermined curve and extends in a longitudinal direction. The curve of each conducting terminals 2 can have a variety of shapes, which is not limited by the curves shown in the figures of the embodiment.

Each conducting terminal 2 is detachably connected to a respective one of the slots 12 of the insulating base 1. The conducting terminals 2 have a maximal width in a direction perpendicular to the longitudinal direction of the conducting terminal 2, where the maximal width is substantially equal to the slot pitches of the slots 12. Each conducting terminal 2 includes an abutting portion 21, a hook portion 22 and a pressing portion 23. For each conducting terminal 2 inserted in a respective slot 12, the abutting portion 21 is arranged in the corresponding abutting groove 13 communicating with the slot 12, the hook portion 22 hooks the block 121 in the slot 12 to firmly assemble the conducting terminal 2 to the slot 12, and the pressing portion 23 extends into the well 122. Furthermore, each conducting terminal 2 can be disassemble from the corresponding slot 12 by pressing the pressing portion 23 thereof.

In this embodiment, each conducting terminal 2 has a first end 2*a* and a second end 2*b* spaced from each other in the longitudinal direction of the conducting terminal 2. The first end 2*a* is approximately parallel to the second end 2*b* and forms the abutting portion 21. Specifically, the pressing portion 23 is a protrusive section formed between the first end 2*a* and the second end 2*b* and preferably perpendicular to the abutting portion 21, and the hook portion 22 is a section between the pressing portion 23 and the second end 2*b* and bent toward the abutting portion 21. Thus, the pressuring portion 23 is located between the abutting portion 21 and the hook portion 22 for each conducting terminal 2.

Figure 4:
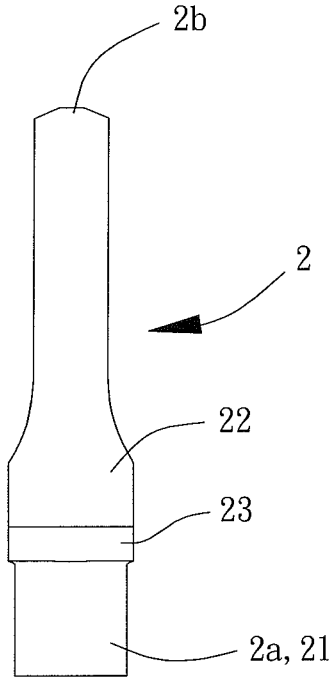
FIG. 4 shows a bottom view of the USB connector of the first embodiment of the present invention.

With further reference to FIG. 4, in this embodiment, in order to enhance the elasticity of the conducting terminals 2, each conducting terminal 2 has a variety of widths in the direction perpendicular to the longitudinal direction of the conducting terminal 2. For each conducting terminal 2, a section between the pressing portion 23 and the abutting portion 21 is formed with the maximal width thereof, and a section between the hook portion 22 and the second end 2*b* can be formed with a reduced width.

In accordance with the above structure, each conducting terminal 2 can be placed into the respective one of the slots 12 via the opening of the slot 12, which is formed on the third surface 11*c* of the insulating base 1, with the pressing portion 23 of the conducting terminal 2 inserted into the well 122.

During the process of placing each conducting terminal 2 into the corresponding slot 12, two sides of the section with the maximal width of each conducting terminal 2 are abutted against the inner side walls of the corresponding slot 12, and the abutting portion 21 of each conducting terminal 2 abuts against the corresponding abutting groove 13 connecting with the slot 12, and the hook portion 22 of each conducting terminal 2 hooks on the corresponding block 121. In such manner, each conducting terminal 2 is fixed into the corresponding slot 12. As a result, the second end 2*b* of each conducting terminal 2 protrudes outwards from the first surface 11*a* and capable of electrically connecting with a conventional USB device (not shown in the FIGS).

The USB connector can further include a circuit board 3 and a housing 4. The circuit board 3 is sandwiched between the at least one positioning member 141 and the third surface 11*c* of the insulating base 1. The circuit board 3 has a plurality of electrical contacts 31 on a surface facing the third surface 11*c* for the electrical contacts 31 to electrically connect with the abutting portions 21 of the conducting terminals 2. The housing 4 is hollow and has a chamber 41 receiving the insulating base 1, conducting terminals 2 and circuit board 3.

During an assembly process, the circuit board 3 is pressed onto the insulating base 1, and the circuit board 3 and the insulating base 1 are then inserted into the chamber 41 of the housing 4 simultaneously. The surface of the circuit board 3, whereon the electrical contacts 31 are formed, is tightly pressed onto the third surface 11*c* through the support and clamping from the housing 4 and the at least one positioning member 141. Thus the abutting portion 21 of each conducting terminal 2 is clamped by the insulating base 1 and circuit board 3 and firmly positioned in the corresponding abutting groove 13. In addition, due to the plurality of protrusion 15 between the second surface 11*b* and an inner surface of the housing 4, the circuit board 3 and the insulating base 1 are fixed into the housing 4 by way of tight fitting, enlarging the clamping force that fixes the abutting portions 2 in the abutting grooves 13 and ensuring the electrical connection between the abutting portion 21 and the electrical contacts 31. As a result, each conducting terminal 2 is accurately and firmly located on a target position on the insulating base 1.

Furthermore, since each electrical contact 31 is coupled to the abutting portion 21 of the corresponding conducting terminal 2 by area contact when the circuit board 3 is firmly coupled to the third surface 11*a*, the contact area between each contact terminal 2 and the electrical contact 31 is increased, ensuring the signal transmission quality. On the other hand, the first surface 11*a* is abutted against the conventional USB device (not shown in the FIGS) when the USB connector is inserted into the conventional USB device, and thus the insulating base 1 does not extended into the conventional USB device, ensuring that parts of each conducting terminal 2 other than the second end 2*b* are prevented form large deformation and that the first end 2*a* is aligned and electrically connects with the corresponding electrical contact 31.

Figure 5:
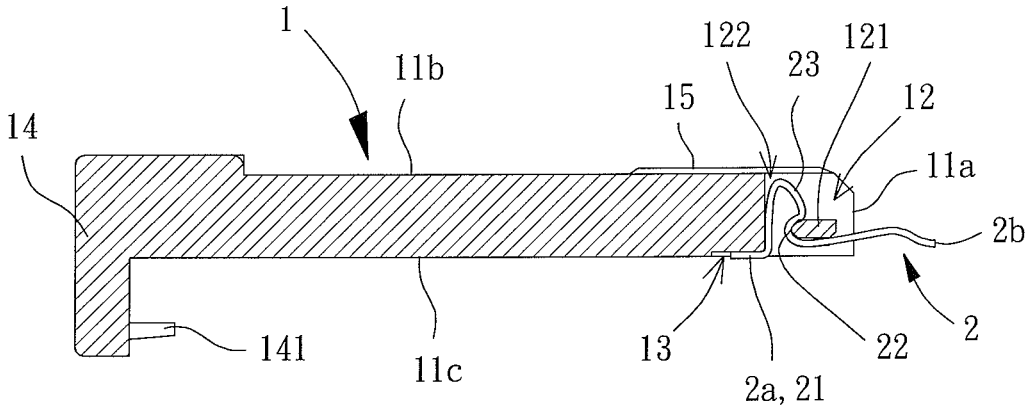
FIG. 5 shows a detailed and cross-sectional view of an assembly example of a conducting terminal of the USB connector of the first embodiment of the present invention.

With reference to FIGS. 1 and 5, when at least one conducting terminal 2 is detected as a bad contact in the assembled USB connector, the housing 4 can be disassembled from the insulating base 1 and circuit board 3 for the circuit board 3 to be removed. Thus, the abutting portions 21 are released from the clamped status.

Figure 6:
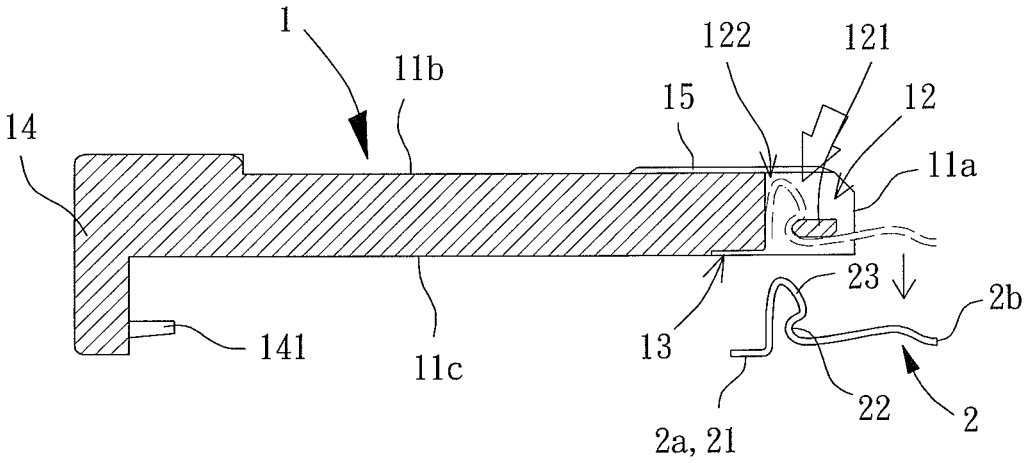
FIG. 6 shows a detailed and cross-sectional view of a disassembly example of a conducting terminal of the USB connector of the first embodiment of the present invention.

With reference to FIGS. 1 and 6, the at least one conducting terminals 2 with bad contacts can then be removed with the pressing portion 23 thereof being pressed and passing through the corresponding well 122. Thus each conducting terminal 2 with a bad contact can be easily replaced by a new conducting terminal 2. According to the above procedure, the USB connector in this embodiment not only allows rapidly replacements for the broken conducting terminals 2, but also preserves the insulating base 1 and the other conducting terminals 2 which transmit signal properly so that the manufacture cost can be reduced.

Figure 7:
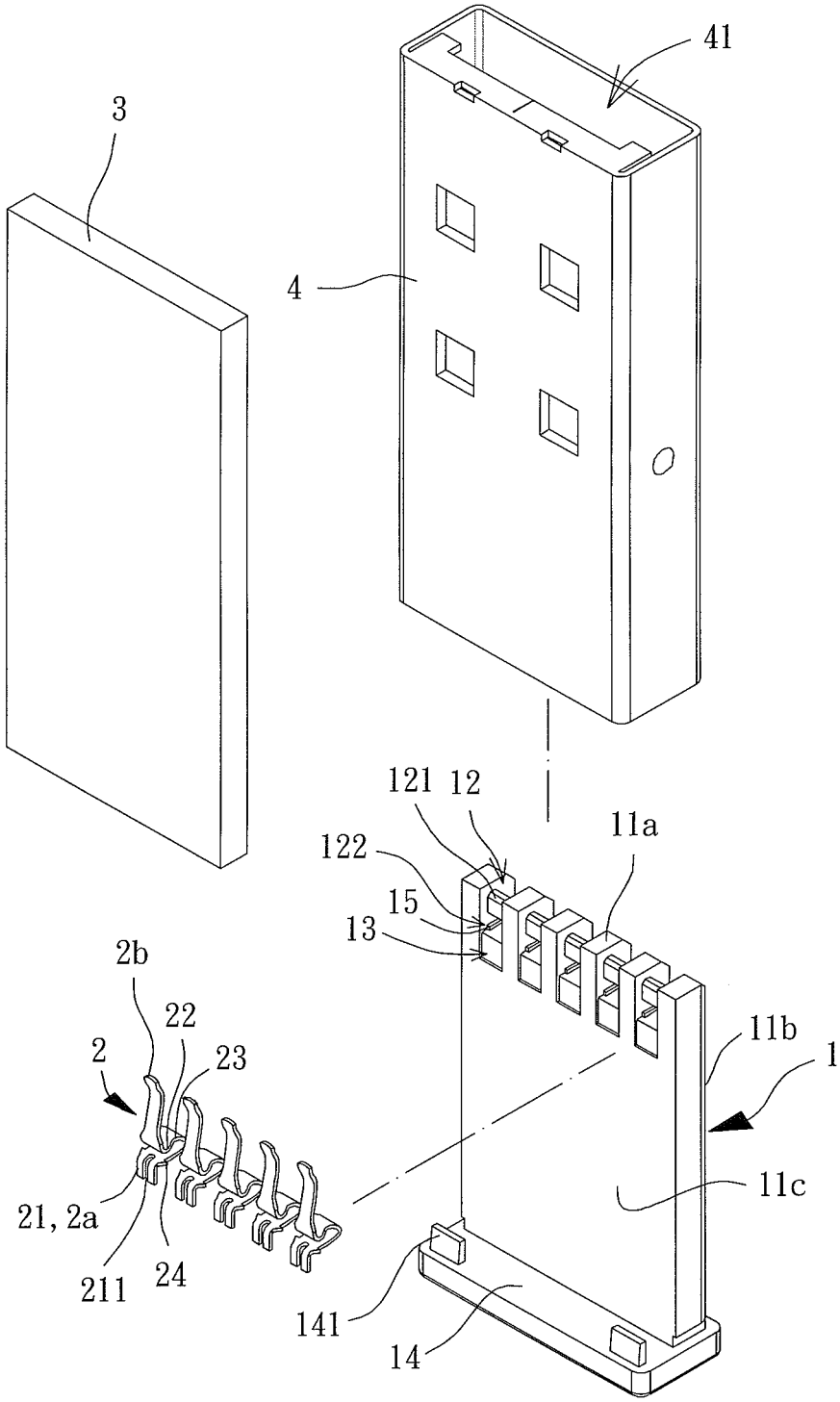
FIG. 7 shows an exploded diagram of a USB connector according to a second embodiment of the present invention.

FIG. 7 shows an exploded diagram of a USB connector according to a second embodiment of the present invention. The configuration of the second embodiment is similar to that of the first embodiment. However, a difference between the first and second embodiments exists in connection structures between the conducting terminals 2 and the insulating base 1. The connection structures of this embodiment may enable each conducting terminal 2 to be connected to the insulating base 1 more firmly.

Figure 8:
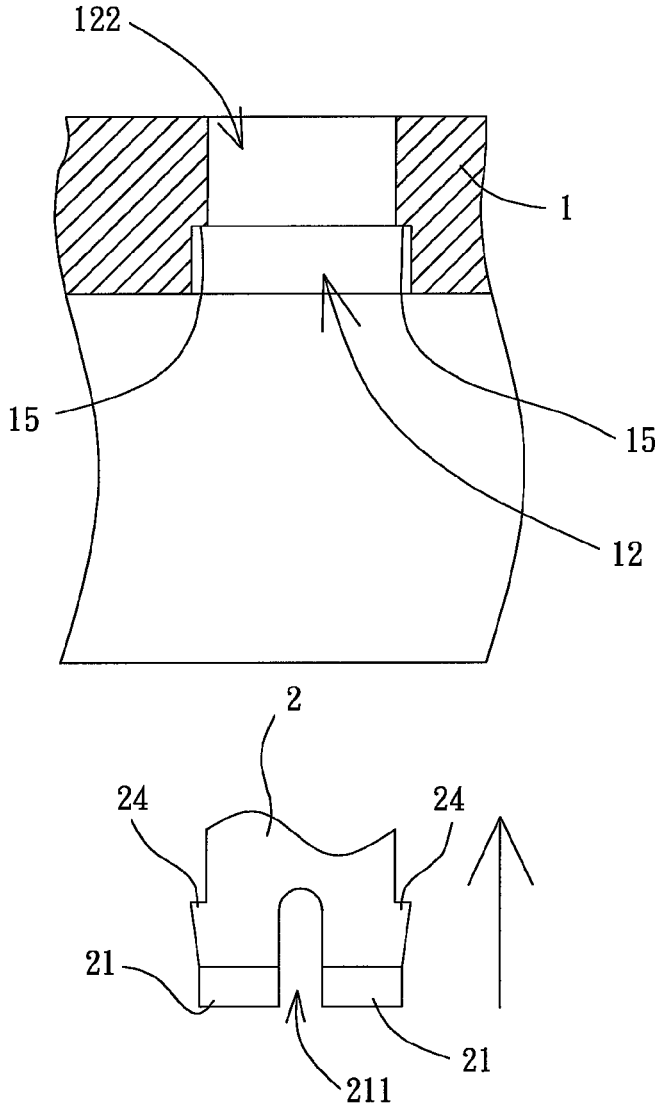
FIG. 8 shows a detailed and cross-sectional view of a connection example of a conducting terminal and an insulating base of the USB connector of the second embodiment of the present invention.

With reference to FIGS. 7 and 8, each slot 12 of the insulating base 1 can have a pair of protruding portions 15 respectively formed on two inner lateral sides of the slot 12. As a result, the width of the slot 12 between the protruding portions 15 is narrowed, which is smaller than the original slot pitch of the slot 12.

Figure 9:
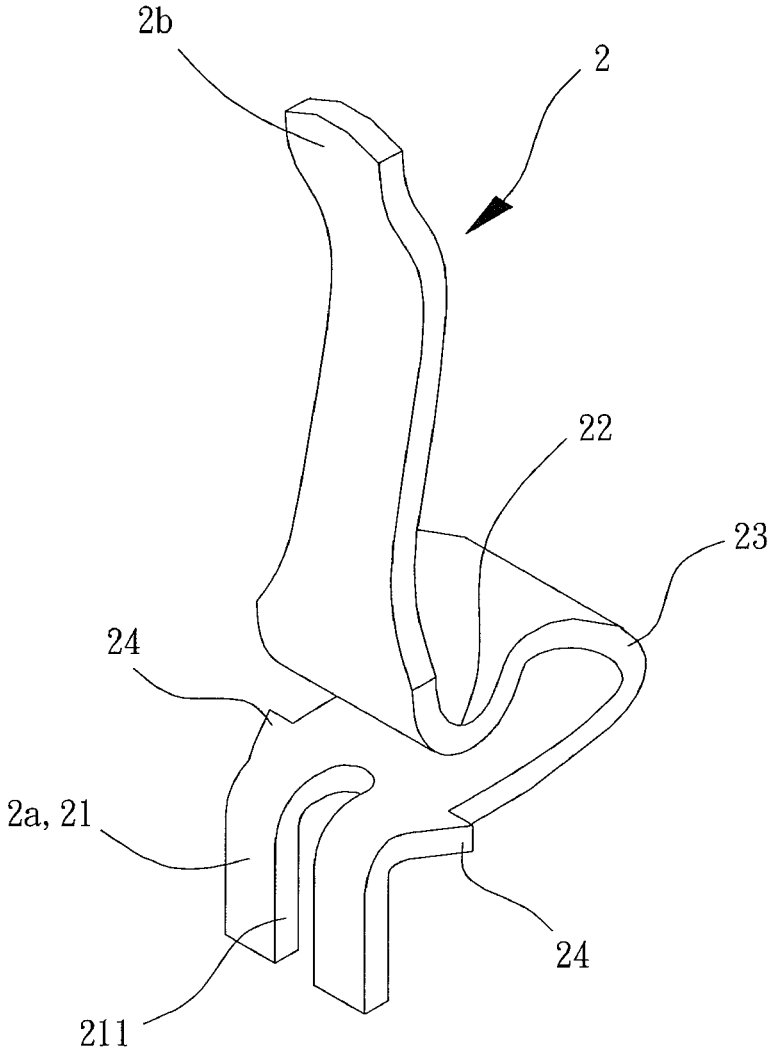
FIG. 9 shows a perspective view of the USB connector of the second embodiment of the present invention.

With reference to FIGS. 8 and 9, in this embodiment, each conducting terminal 2 can have a pair of shoulders 24 on two outer lateral sides of the conducting terminal 2 and adjacent to the abutting portion 21, and a section of the conducting terminal 2 with the shoulders 24 has a width larger than that of the slot 12 between the protruding portions 15. Each conducting terminal 2 can also have a gap 211 extending from the first end 2*a* toward the section having the shoulders 24 and preferably adjacent to the shoulder 24. Preferably, the gaps 211 are parallel to the longitudinal direction of the conducting terminals 2. Thus, each conducting terminal 2 becomes flexible since the maximal width of the conducting terminal 2 can be reduced when parts of the conducting terminal 2 defining the gap 211 are under pressure, and the conducting terminal 2 regains its original maximal width after the pressure removed.

With reference to FIGS. 7 and 8, the shoulder 24 of each conducting terminal 2 is abutted against the corresponding protruding portion 15 when the conducting terminal 2 is inserted into the corresponding slot 12 via the opening on the third surface 11*c*. Accordingly, the protruding portions 15 can limit the insertion depth of the pressing portion 23 in the well 122. On the other hand, since each conducting terminal 2 and the insulating base 1 can match each other under a predetermined tolerance due to the flexibility generated from the gap 211, the conducting terminal 2 is able to firmly connect with the insulating base 1.

Furthermore, as the assembly process mentioned above in the first embodiment, the circuit board 3 is pressed onto the insulating base 1, and the circuit board 3 and the insulating base 1 are then inserted into the chamber 41 of the housing 4 simultaneously. A surface of the circuit board 3 is tightly pressed onto the third surface 11*c* through the support and clamping from the housing 4 and the at least one positioning member 141. Thus the abutting portion 21 of each conducting terminal 2 is firmly clamped in the corresponding abutting groove 13, and each conducting terminal 2 is accurately located on a target position on the insulating base 1. As a result, each conducting terminal 2 is firmly connected to the insulating base 1.

In view of the foregoing, the USB connector according to the present invention accurately locates each conducting terminal 2 on a target position in the corresponding slot 12 and connects the conducting terminal 2 to the insulating base 1, thus avoiding wrong positioning of the conducting terminals 2 during the manufacture process, improving the product yield rate.

The USB connector according to the present invention increases the contact area between each conducting terminal 2 and the corresponding electrical contact 31, strengthens the connection thereof, and ensures the stability and quality of the signal transmission.

The USB connector according to the present invention allows replacements for the broken conducting terminals 2, preserves the insulating base 1 and the other conducting terminals 2 which transmit signal properly, and reduces the manufacture cost.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A USB connector, comprising:

an insulating base having a plurality of slots at an end of the insulating base and a plurality of abutting grooves on a surface of the insulating base, with each abutting groove communicating with a respective one of the slots;

a plurality of conducting terminals received in the plurality of slots, with each conducting terminal being inserted in a respective one of the slots and having an abutting portion arranged in one of the abutting grooves communicating with the respective slot;

a circuit board abutting against the surface of the insulating base whereon forms the abutting grooves, with the circuit board having a plurality of electrical contacts electrically connecting with the abutting portions of the plurality of conducting terminals; and a housing being hollow and receiving the insulating base and the circuit board, wherein a block is formed in each slot and each conducting terminal has a hook portion hooking the block in a respective one of the slots, a well is defined by the block and the inner surfaces of the respect slot, and each conducting terminal has a pressing portion between the abutting portion and the hook portion, with the pressing portion extends into the well, and each slot of the insulating base has a pair of protruding portions respectively formed on two inner lateral sides of the slot, each conducting terminal has a pair of shoulders on two outer lateral sides of the conducting terminal and adjacent to the abutting portion, a section of the conducting terminal with the shoulders has a width larger than that of the slot between the two protruding portions, and each conducting terminal has a gap adjacent to the shoulder.

2. The USB connector as claimed in claim 1, wherein, for each conducting terminal, a section between the pressing portion and the abutting portion 21 is formed with a maximal width of the conducting terminal.

3. The USB connector as claimed in claim 1, wherein, for each conducting terminal, a first end of the conducting terminal forms the abutting portion, the pressing portion is a protrusive section, and the hook portion is a section between the pressing portion and a second end of the conducting terminal and bent toward the abutting portion.

4. The USB connector as claimed in claim 1, wherein a positioning plate is mounted on an end of the insulting base, the positioning plate has at least one positioning member, and each positioning member has a surface facing the said surface of the insulating base.

5. The USB connector as claimed in claim 1, wherein a plurality of protrusions are formed on a surface of the insulating base without the abutting grooves.

* * * * *